US011304586B2

(12) United States Patent
Dingert et al.

(10) Patent No.: US 11,304,586 B2
(45) Date of Patent: Apr. 19, 2022

(54) CLEANING SYSTEM

(71) Applicant: Carl Freudenberg KG, Weinheim (DE)

(72) Inventors: Uwe Dingert, Abtsteinach (DE); Carlo Messineo, Milan (IT)

(73) Assignee: CARL FREUDENBERG KG, Weinheim (DE)

( * ) Notice: Subject to any disclaimer, the term of this patent is extended or adjusted under 35 U.S.C. 154(b) by 117 days.

(21) Appl. No.: 16/632,401

(22) PCT Filed: Jul. 18, 2018

(86) PCT No.: PCT/EP2018/069462
§ 371 (c)(1),
(2) Date: Jan. 20, 2020

(87) PCT Pub. No.: WO2019/016248
PCT Pub. Date: Jan. 24, 2019

(65) Prior Publication Data

US 2020/0205638 A1 Jul. 2, 2020

(30) Foreign Application Priority Data

Jul. 21, 2017 (DE) ..... 102017006890.9

(51) Int. Cl.
*A47L 13/58* (2006.01)
*A47L 13/50* (2006.01)
*A47L 13/24* (2006.01)

(52) U.S. Cl.
CPC ..... *A47L 13/58* (2013.01); *A47L 13/24* (2013.01); *A47L 13/50* (2013.01)

(58) Field of Classification Search
CPC ..... A47L 13/50; A47L 13/58; A47L 13/59
(Continued)

(56) References Cited

U.S. PATENT DOCUMENTS 5,611,104 A * 3/1997 DeMars ..... A47L 13/58 100/132
8,793,834 B2 * 8/2014 Lee ..... A47L 13/58 15/260

(Continued)

FOREIGN PATENT DOCUMENTS

CN 101953669 A 1/2011
CN 102370447 A 3/2012

(Continued)

*Primary Examiner* — Mark Spisich
(74) *Attorney, Agent, or Firm* — Leydig, Voit & Mayer, Ltd.

(57) ABSTRACT

A cleaning system includes: a bucket; a cleaning device with a mop head, the mop head including a carrier body and cleaning fringes that are fixed to the carrier body, the carrier body being connected to a stick on its side facing away from the cleaning fringes; and a washing-out device arranged in the bucket for washing out the cleaning fringes, the washing-out device including a basket settable into an upward and downward movement by a first actuating device, and a spinning device arranged in the bucket for spin-drying the cleaning fringes, the spinning device including the basket, which is settable into rotational movement by a second actuating device, and a centering pin, which is arranged in the basket and centers the cleaning device. The carrier body is essentially disk-shaped, with a circumferential boundary and with a maximum extension d1 between two circumferential areas opposite to each other.

12 Claims, 3 Drawing Sheets

(58) Field of Classification Search
USPC ..... 15/257.01, 260, 263, 264
See application file for complete search history.

(56) References Cited

U.S. PATENT DOCUMENTS

| | | | |
|---|---|---|---|
| 8,978,194 | B1 | 3/2015 | Lentine |
| 2008/0066242 | A1 | 3/2008 | Aiyar |
| 2009/0151399 | A1 | 6/2009 | Lin |
| 2018/0279849 | A1 | 10/2018 | Dingert |

FOREIGN PATENT DOCUMENTS

| | | | | |
|---|---|---|---|---|
| CN | 202269996 | U | | 6/2012 |
| CN | 203597912 | U | | 5/2014 |
| DE | 202008014219 | U1 | | 2/2009 |
| DE | 102011017445 | A1 | | 10/2012 |
| DE | 102014017559 | | * | 1/2016 |
| EP | 2891445 | | * | 7/2015 |
| EP | 3000375 | | * | 3/2016 |
| WO | 96/08194 | A1 | | 3/1996 |
| WO | 2016083281 | A1 | | 6/2016 |

* cited by examiner

CLEANING SYSTEM

CROSS-REFERENCE TO PRIOR APPLICATIONS

This application is a U.S. National Phase application under 35 U.S.C. § 371 of International Application No. PCT/EP2018/069462, filed on Jul. 18, 2018, and claims benefit to German Patent Application No. DE 10 2017 006 890.9, filed on Jul. 21, 2017. The International Application was published in German on Jan. 24, 2019 as WO 2019/016248 under PCT Article 21(2).

FIELD

The invention relates to a cleaning system comprising a bucket and a cleaning device having a mop head, wherein the mop head comprises a carrier body and cleaning fringes secured to the carrier body, wherein the carrier body is connected to a stick on its side facing away from the cleaning fringes.

BACKGROUND

Such a cleaning system is generally known, wherein the previously known cleaning system additionally comprises a wringing device with a funnel-shaped wringing basket.

The wringing device can be clipped onto the upper edge of the bucket in a destruction-free releasable and form-fitting manner. The mop head can be inserted into the wringing basket from above and then pressed into the basket by means of the stick. In doing so, cleaning liquid is pressed out of the cleaning fringes.

When the mop head is pushed into the wringing basket, it reduces its outside diameter by means of articulated lamellas proportionally to the pressure exerted by the user on the mop head by means of the stick.

This additionally supports the pressing out of the cleaning liquid from the cleaning fringes.

The handling of the previously known cleaning system is not very comfortable, because significant forces are required to wring out the cleaning fringes sufficiently, in particular to subsequently clean sensitive surfaces with only slightly damp cleaning fringes.

In addition, a cleaning system, with a spinning device arranged in the bucket for the spin-drying of cleaning fringes of a cleaning device, is known. The spinning device comprises a basket that can be set into rotational movement, for example, by actuating a foot pedal.

In this case, the mop head of the cleaning device has a carrier body, the diameter of which essentially corresponds to the clear width of the basket and therefore practically completely covers the opening of the basket. The cleaning fringes are arranged and pressed in the axial direction of the basket between the carrier body and the bottom of the basket.

In addition, an additional cleaning system, in which a centering pin is arranged in the bucket, on which the mop head can be directly placed for the spin-drying of the cleaning fringes, is known. In order to set the mop head into rotational movement, either a foot pedal or a stick that functions like a drill can be used as an actuating device. Such a cleaning system does not have a basket.

In order to spin the cleaning fringes, the mop head is set into rotational movement by means of the actuating device. Due to the centrifugal forces, the cleaning fringes extend in a radial direction away from the carrier body and the stick in the direction of the boundary wall of the bucket.

As long as the cleaning fringes have a radial extension over everything that is smaller than the diameter of the bucket in this area, the spin-drying of the cleaning fringes works sufficiently well.

However, for the effective and rapid cleaning of surfaces to be cleaned, comparatively long cleaning fringes are advantageous in order to be able to clean as large surfaces as possible in just a few working steps.

For the effective and rapid spin-drying of the cleaning fringes, it is necessary that they do not contact the boundary wall of the bucket surrounding the centering pin during their rotation around the centering pin.

Such contact with the boundary wall of the bucket would result in an undesired slowing down of the rotation of the mop head, in high forces being required to maintain rotation and the spin-drying of the cleaning fringes therefore functioning only insufficiently.

In order to avoid the aforementioned disadvantages, the bucket could have a very large diameter that is dimensioned in such a manner that even long cleaning fringes do not contact the bucket during spin-drying. However, such buckets would have undesirably large dimensions and would not be practical to handle due to their large volume.

SUMMARY

In an embodiment, the present invention provides a cleaning system, comprising: a bucket; a cleaning device with a mop head, the mop head comprising a carrier body and cleaning fringes that are fixed to the carrier body, the carrier body being connected to a stick on its side facing away from the cleaning fringes; and a washing-out device arranged in the bucket and configured to wash out the cleaning fringes, the washing-out device comprising a basket settable into an upward and downward movement by a first actuating device, and a spinning device arranged in the bucket configured to spin-dry the cleaning fringes, comprising the basket, which is settable into rotational movement by a second actuating device, and a centering pin, which is arranged in the basket and configured to center the cleaning device, wherein the carrier body is essentially disk-shaped, with a circumferential boundary and with a maximum extension d1 between two circumferential areas opposite to each other, wherein the basket is rotationally symmetrical, with a maximum clear first width d2, and wherein a first ratio of d2 to d1 is ≥1.5.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
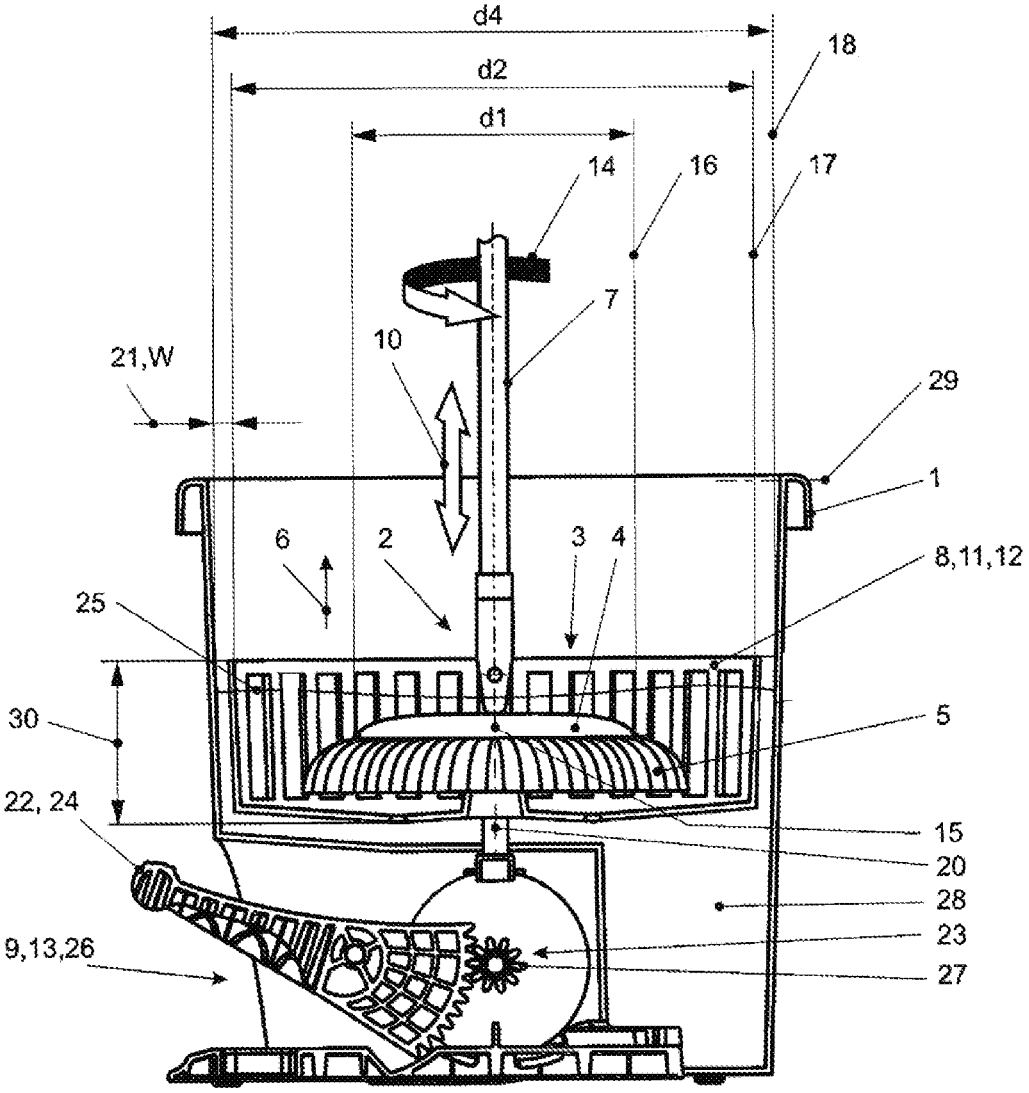
FIG. 1 a bucket with washing-out device and spinning device, wherein, in FIG. 1, the washing-out device is in operation, FIG. 2 the basket from FIG. 1 as an individual component, FIG. 3 the cleaning system from FIG. 1, wherein, in FIG. 3, the spinning device is in operation.

In an embodiment, the present invention provides a cleaning system of the previously known type in such a manner that, despite its compact dimensions, it has very good performance characteristics, in particular that in a compact bucket and a compact basket, even long cleaning fringes of a cleaning device can be first thoroughly washed out and then well spun dry, and that the cleaning device has a large wiping area during its intended use due to comparatively long cleaning fringes, and therefore even large surfaces can be cleaned rapidly and effectively.

In an embodiment, the present invention provides a cleaning system comprising a bucket and a cleaning device with a mop head, wherein the mop head comprises a carrier body and cleaning fringes that are fixed to the carrier body, wherein the carrier body is connected to a stick on its side facing away from the cleaning fringes, and a washing-out device arranged in the bucket for washing out the cleaning fringes, comprising a basket that can be set into an upward and downward movement by a first actuating device, and a spinning device arranged in the bucket for spin-drying the cleaning fringes, comprising the basket, which can be set into rotational movement by a second actuating device, and a centering pin, which is arranged in the basket for centering the cleaning device, wherein the carrier body is formed to be essentially disk-shaped, with a circumferential boundary and with a maximum extension d1 between two circumferential areas opposite to each other, wherein the basket is formed to be rotationally symmetrical, with a maximum clear first width d2 and wherein a first ratio of d2 to d1 is ≥1.5.

The advantage of this is that the cleaning system has good usage properties and that the cleaning fringes of the cleaning device can be thoroughly washed out in the cleaning system in accordance with the invention and can then be effectively and conveniently spun dry.

The function is described as follows:

In order to wash out the cleaning fringes, the cleaning device with its mop head is inserted into the basket of the washing-out device. In the process, the basket is lowered into the bucket as far as possible, namely into cleaning liquid received in the bucket.

In order to wash out the cleaning fringes thoroughly, it is necessary that they are sufficiently wetted by the cleaning liquid during the washing-out process, have good mobility relative to each other and, if possible, can float freely in the cleaning liquid.

It would not be expedient to press the cleaning fringes between the carrier body and the basket relative to each other. The cleaning fringes could no longer be thoroughly washed out as a result of the relative mobility to each other that would then no longer exist or at least be severely restricted.

For this reason, it is advantageous if the ratio of d2 to d1 is ≥1.5. This ratio ensures in any event that, in the radial direction between the outer circumference of the carrier body and the circumference of the basket, there remains an annular space that is open at the top. While the cleaning fringes are being washed out, they can move relatively freely with respect to each other, and the annular space, which is open at the top, prevents the cleaning fringes from being pressed together and therefore not being washed out with sufficient thoroughness.

After washing out the cleaning fringes in the washing-out device, the basket located deeply in the bucket is set to move upward by the first actuating device in such a manner that the basket is above the water level in the bucket. The same basket, which was previously part of the washing-out device, now forms a part of the spinning device.

The mop head with the previously washed-out cleaning fringes is then set into rotational movement together with the basket by a second actuating device in order to spin dry the cleaning fringes. The cleaning fringes, even if they have a maximum radial extension over everything that is greater than the dimensions of the bucket, are deposited in the basket for spin-drying and thus cannot contact the boundary wall of the bucket.

With comparatively little effort, the basket can be set into a rapid rotational movement by the second actuating device so that the cleaning fringes can be spun dry efficiently, that is, highly extensively in a short time.

Due to the first ratio in accordance with the invention, even long cleaning fringes in compact buckets and compact baskets can be initially washed out well and then efficiently spun dry.

An advantageous embodiment provides that the first ratio is 1.5 to 2.5. The advantage of this is that the annular space described above and required for good performance properties during washing out is always maintained.

If, on the other hand, the first ratio is significantly higher than 2.5, the cleaning device cannot be thoroughly washed out in an acceptable period of time, due to, on the one hand, its very long cleaning fringes.

On the other hand, the handling of the cleaning device for wiping surfaces to be cleaned is then no longer good. In such a case, the cleaning device would be unwieldy and heavy.

Due to their manufacturing, cleaning fringes protruding radially from the carrier body have a maximum radial extension over everything d3, wherein a second ratio of d3 to d2 is >1.

Further preferably, the second ratio is 1.25 to 1.75.

Such a ratio makes it clear that the length of the cleaning fringes can be greater than the diameter of the basket. When the cleaning fringes are spun dry, they are held inside the basket and the cleaning fringes are prevented from contacting the boundary wall of the bucket during spin-drying and the rotational movement from thereby slowing down.

An advantageous arrangement can provide that the bucket surrounds the basket at a radial distance and, as viewed over the axis of rotation of the basket, has a clear second width d4, and that a third ratio of d3 to d4 is >1.

Further preferably, the third ratio is 1.25 to 1.75.

The second and third ratios are essentially the same. This is particularly the case if the basket has the largest possible clear first width d2 in order to be able to take up many long cleaning fringes without any problem. The clear first width d2 is greatest when it practically corresponds to the second clear width d4 of the bucket.

If the third ratio is considerably higher than 1.75, the handling of the cleaning device, as described above, is unsatisfactory because of the very long cleaning fringes.

The carrier body and basket may delimit an essentially circular ring-shaped annular space, wherein the annular space has a radial width W and wherein a fourth ratio of W to d3 is ≥0.25.

The fourth ratio further preferably is 0.33 to 0.67.

Such a ratio ensures that the cleaning fringes can always move freely enough and relative to each other when washing out in the washing-out device. Because of the annular space open at the top, the cleaning fringes are at most insignificantly impeded in their mobility by the carrier body. Even if the cleaning fringes have a maximum volume due to maximum absorption of cleaning liquid, they are not pressed together undesirably strongly but can escape upward through the annular space as required.

The centering pin is preferably arranged in the axis of rotation of the basket, wherein the centering pin and the basket are connected to each other in a destruction-free releasable and force-fitting and/or form-fitting manner.

The basket can be connected to the centering pin by a snap-in connection, for example. This snap-in connection ensures that the basket can be adjusted in height through an upward and downward movement by means of the first actuating device using the centering pin in the bucket.

The first actuating device may be formed by a lever with at least one articulation, wherein the centering pin is arranged on the one side and a first actuating pedal 22 is arranged on the other side of the articulation. The actuating pedal can be formed as a foot pedal. As a result, it is easily possible for the user of the cleaning system to clasp the cleaning device during washing out and subsequent spin-drying with both hands on the stick and to operate the actuating pedal with one foot.

The basket may be arranged at the highest point in the bucket and completely above an essentially mean water level in the bucket when the first actuating device is actuated. By actuating the first actuating device, the basket inside the bucket is brought into the spinning position. In order to be able to spin the cleaning device as rapidly and effectively as possible, it is advisable for the basket for the spin-drying of the cleaning fringes in the bucket to be arranged completely outside the cleaning liquid.

The basket may be arranged at the lowest point in the bucket and at least partially below the essentially mean water level in the bucket when the first actuating device is not actuated. Further preferably, the basket can be arranged in the bucket completely below the essentially mean water level in the bucket when the first actuating device is not actuated. The advantage here is that the mop head and thus also the cleaning fringes are completely immersed in the cleaning liquid during washing out. The cleaning fringes are therefore washed out particularly rapidly and thoroughly.

The second actuating device may be formed by a second actuating pedal 24 and may comprise a gearing mechanism 27 for converting a translational movement of the second actuating pedal into a rotational movement of the basket.

With regard to the simplest possible and cost-effective structure of the cleaning system, in particular with regard to a structure of the cleaning system that as few parts as possible, the first actuating device and the second actuating device can be combined into a common actuating pedal 26. This also makes it easier for the user to handle the cleaning system.

The second actuating device can, for example, comprise a freewheel 23 so that the basket with the mop head arranged thereon, once driven, remains in rotation, at least temporarily, even if the actuating pedal is not actuated.

The bucket may have a maximum internal height 29 that can be filled with a cleaning liquid and that corresponds essentially to twice the height of the essentially mean water level in the bucket and essentially to twice the height of the basket. Such size ratios have proven to be advantageous in particular because one and the same cleaning system can be used, on the one hand, to wash out the cleaning fringes and, on the other hand, to spin dry the cleaning fringes previously washed out in the cleaning liquid. Ideally, the cleaning fringes are completely immersed in the cleaning liquid during washing out. When spinning, the cleaning fringes to be spun dry then ideally no longer come into contact with the cleaning liquid in the bucket.

Figure 3:
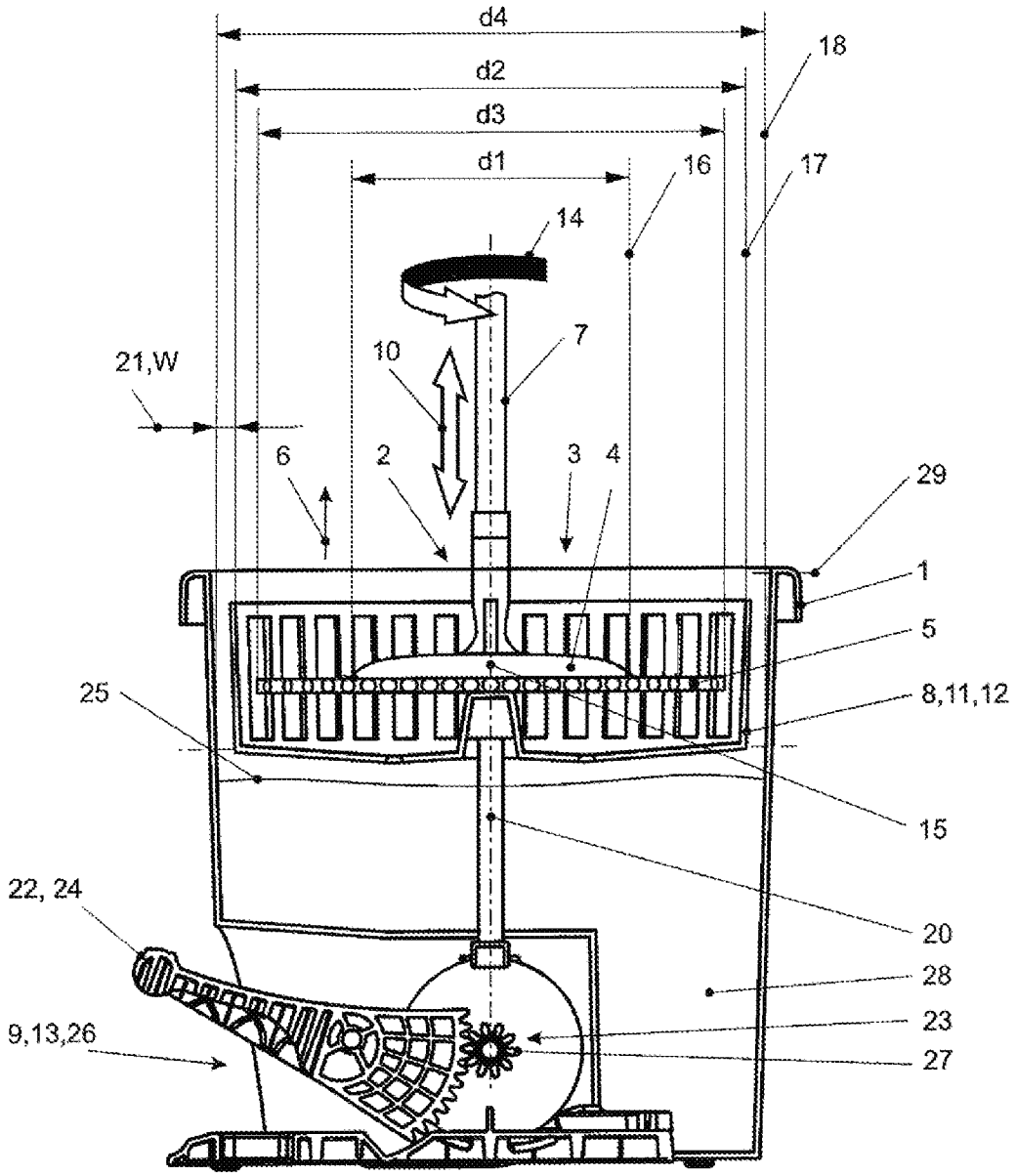

FIGS. 1 and 3 show the same cleaning system in different operating states.

In FIG. 1, the washing-out device 8 for washing out the cleaning fringes 5 is in operation; by contrast, the spinning device 12 for spin-drying the previously washed-out cleaning fringes 5 is in operation in FIG. 3.

The cleaning system comprises the bucket 1, which is made of a polymeric material in the exemplary embodiment shown here.

In addition, the cleaning system comprises a cleaning device 2 in the form of a fringe mop, wherein the cleaning device 2 comprises the mop head 3. The mop head 3 on its part comprises the carrier body 4 and the cleaning fringes 5, which are fixed to the carrier body 4. On its side 6 facing away from the cleaning fringes 5, the carrier body 4 is connected to the stick 7, wherein, in this example, the stick 7 is connected to the carrier body 4 by a cardanic articulation.

The washing-out device 8 and the spinning device 12 are arranged in the bucket 1.

The washing-out device 8 is intended for washing out the cleaning fringes 5.

In contrast, the spinning device 12 is intended for the spin-drying of the cleaning fringes 5.

A crucial component of both the washing-out device 8 and the spinning device 12 is the common basket 11, which, as a component of the washing-out device 8, can be set into an upward and downward movement 10 by the first actuating device 9 and, as a component of the spinning device 12, can be set into a rotational movement 14 by the second actuating device 13.

The two actuating devices 9, 13 can, for example, be combined into one unit 26 or installed separately from each other.

In the exemplary embodiment shown here, the centering pin 15 is provided for centering both the cleaning device 2 in the basket 11 and the basket 11 in the bucket 1.

The function is described as follows:

In order to wash out the cleaning fringes 5, the cleaning device 2 with its mop head 3 is inserted into the basket 11 of the washing-out device 8. In the process, the basket 11 is lowered as far as possible into the bucket 1, namely completely into the cleaning liquid 28, which is in the bucket 1.

In order to be able to thoroughly wash out the cleaning fringes 5, it is necessary that they show a good mobility relative to each other during washing-out and can float freely in the cleaning liquid 28 if possible.

The first ratio of d2 to d1 is $\geq 1.5$.

This first ratio ensures in any event that an annular space 21, which is open at the top, remains in the radial direction between the outer circumference of the carrier body 4 and the circumference of the basket 11. During the washing out of the cleaning fringes 5, they can therefore move particularly freely relative to each other and the annular space 21, which is open at the top, prevents the cleaning fringes 5 from being pressed together, from being hindered in their relative movement relative to each other and thus not being effectively washed out.

The following conditions in combination are decisive for one and the same cleaning system to be able to be used very well for washing out the cleaning fringes 5 on the one hand and very well for spin-drying the cleaning fringes 5 on the other hand.

The following conditions are always a matter of ensuring that the cleaning fringes 5 to be washed out can move in a manner relatively uninfluenced by each other and relatively freely in relation to each other in the washing-out device 8.

In the spinning device 12, the previously washed-out cleaning fringes 5 should be spun dry as rapidly and thoroughly as possible.

In the exemplary embodiment shown here, the basket 11 is formed by a circular bottom and a circular ring-shaped shell connected to the bottom. The basket 11 has a uniform material design, consists of a polymeric material and is permeable to water.

d1 designates the diameter 16 of the carrier body 4, d2 designates the diameter 17 of the basket 11, d3 designates the diameter of the cleaning fringes 5 that protrude radially from the carrier body 4, wherein the radial extension is measured over everything, i.e., from a free end of the cleaning fibers 5 over the carrier body 4 to the radially opposite free end of the cleaning fibers 5.

d4 designates the diameter 18 of the bucket 1 in the area of the basket 11, wherein the bucket 1 in the exemplary embodiment shown here is formed to be essentially oval.

W designates the radial width of the annular space 21, which is bounded by the carrier body 4 on the inside in the radial direction and by the shell of the basket 11 on the outside in the radial direction.

In the exemplary embodiment shown here, the first ratio is 1.5 to 2.5, the second ratio, as well as the third ratio, is 1.25 to 1.75. The fourth ratio in the exemplary embodiment shown here is approximately 0.5.

In particular when spin-drying the cleaning fringes 5 in the spinning device 12, the advantage to be emphasized is that the cleaning fringes 5 do not contact the boundary wall of the bucket because the cleaning fringes 5 are arranged in the basket 11.

FIG. 1 shows the basket 11 with the first actuating device 9, which is not actuated, wherein the basket 11 and the mop head 3 arranged in the basket 11 are arranged at the lowest point and completely below the mean water level 25 in the bucket 1.

The cleaning fringes float largely freely within the cleaning liquid 28 and are thereby washed out well.

In FIG. 3, the first actuating device 9 is actuated and the basket 11 and the mop head 3 are arranged in the bucket 1 at the highest point and completely above the mean water level 25.

The entire cleaning system has a simple structure with few parts, is therefore easy and inexpensive to manufacture, has a relatively low weight in relation to the many functionalities and is easy to handle.

Figure 2:
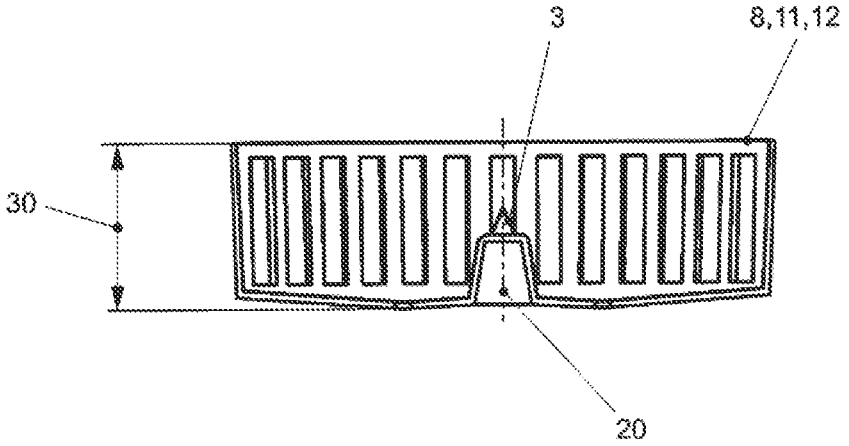

In FIG. 2, the basket 11 from FIGS. 1 and 3 is shown as an individual component.

The basket 11 is a central component of both the washing-out device 8 and the spinning device 12.

Reference sign 20 designates the axis of rotation and reference sign 30 designates the height of the basket 11. The mop head 3 to be used is arranged in the axis of rotation 20 during the intended use of the cleaning system.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A cleaning system, comprising:

a bucket;

a cleaning device with a mop head, the mop head comprising:

a carrier body, and cleaning fringes that are fixed to the carrier body, and a stick on its side facing away from the cleaning fringes, wherein the carrier body is connected to the stick; and a washing-out device arranged in the bucket and configured to wash out the cleaning fringes, the washing-out device comprising:

a basket settable into an upward and downward movement by a first actuating device, a spinning device arranged in the bucket, the spinning device configured to spin-dry the cleaning fringes, and a centering pin, which is arranged in the basket and configured to center the cleaning device, wherein the basket is settable into rotational movement by a second actuating device, wherein the carrier body is essentially disk-shaped, with a circumferential boundary and with a maximum extension d1 between two circumferential areas opposite to each other, wherein the basket is rotationally symmetrical, with a maximum clear first width d2, and wherein a first ratio of d2 to d1 is ≥1.5, wherein responsive to the first actuating device being actuated, the basket is arranged at a high point in the bucket that is above an essentially mean water level in the bucket, and wherein responsive to the first actuating device not being actuated, the basket is arranged at a low point in the bucket that is at least partially below the essentially mean water level in the bucket.

2. The cleaning system according to claim 1, wherein the first ratio is 1.5 to 2.5.

3. The cleaning system according to claim 1, wherein the cleaning fringes protrude radially from the carrier body, wherein the cleaning fringes have a maximum radial extension d3, and wherein a second ratio of d3 to d2 is >1.

4. The cleaning system according to claim 3, wherein the second ratio is 1.25 to 1.75.

5. The cleaning system according to claim 3, wherein the bucket surrounds the basket with a radial distance and, as viewed over an axis of rotation of the basket, has a clear second width d4, and wherein a third ratio of d3 to d4 is >1.

6. The cleaning system according to claim 5, wherein the third ratio is 1.25 to 1.75.

7. The cleaning system according to claim 3, wherein the carrier body and the basket delimit an essentially circular ring-shaped annular space, wherein the annular space has a radial width W, and wherein a fourth ratio of W to d3 is ≥0.25.

8. The cleaning system according to claim 7, wherein the fourth ratio is 0.33 to 0.67.

9. The cleaning system according to claim 1, wherein the centering pin is arranged in an axis of rotation of the basket, and wherein the centering pin and the basket are connected to each other in a destruction-free releasable and force-fitting and/or form-fitting manner.

10. The cleaning system according to claim 1, wherein the first actuating device comprises a lever with at least one articulation, and wherein the centering pin is arranged on a first side of the at least one articulation and a first actuating pedal is arranged on a second side of the at least one articulation.

11. The cleaning system according to claim 1, wherein the second actuating device comprises a second actuating pedal and a gearing mechanism configured to convert a translational movement of the second actuating pedal into a rotational movement of the basket.

12. The cleaning system according to claim 1, wherein the bucket has an internal height that is fillable to a maximum height with a cleaning liquid and that corresponds essentially to twice a height of the essentially mean water level in the bucket and essentially to twice a height of the basket.

* * * * *